US006023956A

United States Patent [19]

Bayer

[11] Patent Number: 6,023,956

[45] Date of Patent: Feb. 15, 2000

[54] DEVICE FOR BENDING A HOLLOW SECTION WITH A HOLD DOWN CLAMP

[75] Inventor: Franz Bayer, Elzach, Germany

[73] Assignee: Franz Xaver Bayer Isolierglasfabrik KG, Elzach, Germany

[21] Appl. No.: 09/127,418

[22] Filed: Jul. 31, 1998

[30] Foreign Application Priority Data

Aug. 2, 1997 [DE] Germany ..... 197 33 536

[51] Int. Cl.[7] ..... B21D 7/02

[52] U.S. Cl. ..... 72/217; 72/219; 72/316; 72/322

[58] Field of Search ..... 72/214, 215, 216, 72/217, 219, 157–159, 369, 387, 388, 307, 173–175, 316, 322, 323

[56] References Cited

U.S. PATENT DOCUMENTS

| | | | |
|---|---|---|---|
| 4,938,050 | 7/1990 | Kimura | 72/217 |
| 5,220,818 | 6/1993 | Hansen | 72/217 |
| 5,640,828 | 6/1997 | Reeves et al. | 72/369 |
| 5,705,010 | 1/1998 | Larsen | 72/369 |
| 5,794,481 | 8/1998 | Lisec | 72/316 |

FOREIGN PATENT DOCUMENTS

| | | |
|---|---|---|
| 121 873 | 10/1984 | European Pat. Off. . |
| 0 121 873 B1 | 2/1988 | European Pat. Off. . |
| 318 748 | 6/1989 | European Pat. Off. . |
| 0 318 748 B1 | 9/1992 | European Pat. Off. . |
| 0 582 064 B1 | 2/1994 | European Pat. Off. . |
| 582 064 | 2/1994 | European Pat. Off. . |
| 32 21 986 | 12/1983 | Germany . |
| 3221 986 C2 | 11/1988 | Germany . |

OTHER PUBLICATIONS

Search Report dated Jul. 12, 1999 for corresponding European Application No. EP 98 11 3861.

*Primary Examiner*—Ed Tola

*Attorney, Agent, or Firm*—Akin, Gump, Strauss, Hauer & Feld, L.L.P.

[57] ABSTRACT

An apparatus (1) serves to bend a hollow section (2) with which a spacer frame for insulating glass sheets is to be manufactured. For this purpose, the hollow section (2) can already be filled with drying agent during bending or, however, still be empty. The bending apparatus also has, in addition to a bending tool (11) and an abutment (13), a hold-down clamp (17) for impinging upon a side band (6) and/or a flange (10) whose cross section continues internally, and parallel thereto a support (16), so that the external proportions of the hollow section (2) remain precisely preserved even in the bending area (4). In order to support thereby the bending motion and the deformation, as well as the flow of the material of the hollow section (2) and its side bands (6)/flanges (10), the hold-down clamp (17) is subdivided and has an element (171) co-rotatable with the bending motion in the bending direction, which supports the change of direction of the side band (6)/flange (10) during the bending operation.

16 Claims, 6 Drawing Sheets

DEVICE FOR BENDING A HOLLOW SECTION WITH A HOLD DOWN CLAMP

BACKGROUND OF THE INVENTION

The invention concerns an apparatus for bending a hollow section for producing a hollow spacer frame, filled with drying agent during or after bending, for insulating glass sheets, having a guide and retaining device approximately in the feed direction of the hollow section for grasping the region of the section situated before the bending point, having a device acting or serving as a bending tool for grasping and swivelling the leg of the hollow section to be bent around, and having an abutment for fixation of the inner side of the resulting bend or curvature. The apparatus optionally has a tool movable on the outer side of the bending point under surface pressure relative to the abutment and to the hollow section and pressable on the outer side of the hollow section and/or dipping between side bands of the hollow section, the tool being especially in the fonn of a pressure roller acting on at least one part of the section band situated on the outer side of the bend, wherein a support for a side band or a portion of a side band of the hollow section and parallel thereto a hold-down clamp for the other side band or a part of the other side band of this hollow section are provided. The distance between hold-down clamp and support corresponds approximately to the width of the hollow section and consequently to the subsequent clearance between two glass sheets to be held at a distance.

Such an apparatus for bending a space holding interior frame or spacer frame for an insulating glass sheet known from DE-B-32 21 986 as a component of a bending machine.

An apparatus of this type for bending a spacer frame filled with drying agent is furthermore known from EP-B-0 121 873, and a device of this type for bending a hollow section filled, or at first unfilled, with drying agent is known from EP-B-0 318 748. These devices have proven themselves because a bending of hollow sections with or without drying agent with a narrow bending angle is thereby possible, without the side bands being deformed in the bending area or containing deformations, and without the glass sheets to be placed thereon no longer being able to be kept at a distance and sealed off in a satisfactory manner and with sufficient exactitude.

Besides, with the previously known devices, chiefly extruded hollow sections with an indeed relatively thin wall thickness can be processed in a satisfactory manner. Nonetheless, a further diminution of wall thickness is not possible, since otherwise, despite this, an uncontrolled deformation of the side bands in the bending area cannot be ruled out. In addition, when bending hollow sections made of steel or stainless steel, it must be feared that in the bending area the side bands will lead to jamming between hold-down clamp and support in the bending area, or that the tightening and afterflow of the side band material will be hindered around the bend, so that the bending result is unsatisfactory, chiefly in the area of this side band.

SUMMARY OF THE INVENTION

For this reason, underlying the invention is the object of creating an apparatus of the type mentioned at the beginning, in which the advantages of the previously known devices with respect to good guidance and bending, especially of the section band of the hollow section situated on the outer side of the bending point, as well as of the section band situated on the inner side are retained, and thereby also be able to keep the side bands in the bending area at an exact exterior distance corresponding to the distance to be maintained between two glass sheets, even if a thinner walled extruded hollow section (for example with wall thicknesses on the order of approximately a tenth of a millimeter or up to about two tenths of a millimeter) or a hollow section made of steel or stainless steel is to be bent, wherein the spacer frame, despite the diminished wall thickness, should have sufficient stability and especially fatigue strength in the bending area as well.

The solution to this in part contradictory-appearing objective consists in an apparatus of the type mentioned at the beginning, wherein the hold-down clamp is subdivided, and a part of the hold-down clamp situated in the bending area can be rotated at least approximately about the bending angle, wherein the rotation axis for this rotatable part of the hold-down clamp is arranged approximately through the neutral axis of the hollow section to be bent, or this is arranged radially displaced relative to the bend interior, and wherein a part of the hold-down clamp situated before this rotatable part of the hold-down clamp in the feed direction of the hollow section is provided stationary.

Surprisingly, the hold-down clamp serving to fix the hollow section during bending is thus subdivided, wherein a part of the hold-down clamp situated before the bending area and before the bending point is stationary, thus practically holding the grasped section fixed in place, while the rotatable part of the hold-down clamp supports the material of the side band impinged upon by it during the deformation by bending and during the necessary flowing behavior of the material occurring thereby. However, this part does not prevent this deformation and the thereby-resulting cold-flowing of the material out of a first straight orientation into the bent position, so that a bulging and a buckling or the development of creases enlarging the distance to the parallel side band can be avoided. The rotatable part of the hold-down clamp lies practically on the portion of the side band of the hollow segment to be bent, which for its part should execute a sort of rotation or swivelling motion owing to the bending, which a stationary hold-down clamp or a hold-down clamp running across and overhanging the entire bending area could hinder.

In this connection, it is especially appropriate if the rotation axis for the co-rotating part of the hold-down clamp coincides with the swivel axis of the bending tool, and if a synchronous rotation of the rotatable part of the hold-down clamp is provided. It is easy to see that in this way, the hold-down clamp supports the deformation of the side band held by it from an initially straight course into a bent course, and supportingly cooperates in the necessary conveyance of the material of the side band around the axis of bending. Relative movements between hold-down clamp and the area of the side band impinged upon by it are kept as small as possible.

The support for the section to be bent can also have a co-rotatable part situated in the bending area, whose rotation axis is in alignment with that of the co-rotatable part of the hold-down clamp, and the common rotation axes of the co-rotatable parts of the hold-down clamp and of the support are furthermore arranged at right angles to the hold-down clamp surface and the support surface, and thereby at right angles to the side bands of the section. Practically speaking, the two side bands are then impinged upon by a co-rotating part and at the same time, however, nonetheless kept at a distance, so that also a uniform introduction of bending and possibly small friction forces occurs simultaneously on both side bands in an approximately symmetrical manner and of equal magnitude, at least as far as possible. Consequently, the danger of squeezing and uneven bendings of the parallel side bands is kept as low as possible by the largely synchronous impingement with the co-rotating parts.

Through the rotatable parts of the hold-down clamp and the support and its simultaneous rotation together with the bending movement, the material of the hollow section in the bending area of the side bands is driven and taken along in the direction in which it should also move in the bending operation, so that it also becomes largely free of tension and without deflections unfavorably influencing distances between the side bands in the bending region or being deformed in like manner. Owing to this "drive," tightening forces on the bending beams can be kept relatively low with the aid of the rotatable part of the hold-down clamp and the support as well, since the flow of the material around the bend is supported by the rotatable and co-rotating parts.

An expedient configuration of the invention which favors the pulling along of the material into the bending region and around the bend in the area of the side bands as well can consist in that the stationary part of the hold-down clamp has a slight play or a sliding fit in relation to the hollow section to be bent. This leads, on the one hand, to a sufficiently good setting of the part of the hollow section lying before the bending point, but at the same time does not hold the hollow section, above all also in the area of the side bands, so firmly that no material can be pulled along into the bending area and around it. A further advantage of this play occurs above all with hollow sections filled with drying agent, which are correspondingly strongly exposed to pressure from all sides in the bending area, and to be sure also by the abutment and the tool engaging the outside of bending point, so that the drying agent experiences an internal pressure, such that it extends the section somewhat in the area of the play of the hold-down clamp and consequently leads to a diminution of this play.

Furthermore, it is expedient if the workpiece formed as a hollow section is maintained free from play and/or clamped in the feed direction behind the bending area between the hold-down clamp and support or in the bending tool serving to grasp the leg to be bent. A precise movement and swivelling is thereby made possible, and sliding relative to the bending tool is avoided.

An important and advantageous further configuration of the bending apparatus of the type mentioned at the beginning, worthy of protection on its own significance, can consist in that the abutment is deflectable transversely to its longitudinal extension, especially swinging, mounted in such a manner that its range of action is movable back and forth between support and hold-down clamp.

It can thereby be achieved that following the bending operation and the opening of the hold-down clamp or the entire apparatus, the abutment can cooperate with ejecting the finished bent workpiece, since it loosens the section bent under the unfolding of force from the support by a lifting movement in relation to the support. In addition, the possibly even more important further advantage results that, during the bending process, with the hold-down clamp closed or in use position, irregularities within the section itself or on its side bands or irregularities brought about by a drying agent filling in the bending area do not lead to a clamping on the abutment, because the abutment can automatically adapt to such irregularities between the support and hold-down clamp even upon dipping in or grasping into the section to be bent, or between the bands located on it. The abutment thus has to a certain extent a "floating" mounting and is moved during the bending operation between the support and the hold-down clamp into the respective best position for the section to be bent, so that internal tensions which would otherwise become too great at this point, with a jamming for example between abutment and hold-down clamp or between abutment and support, can be avoided to the greatest extent possible.

A further advantage of this abutment configured as "floating," with a mobility between support and hold-down clamp can then be utilized, if the width of this abutment is larger in relation to the distance between support and hold-down clamp than the two bands located there, between which the abutment engages or dips under compression, so that the side bands for their part have more space in relation to the hold-down clamp up to the abutment and its side facing the hold-down clamp, and can be shaped during bending in part intentionally yielding toward the inside depending the material, without, however, the outer distance of the side bands being capable of enlargement in the bending area. In this way, folds can be deliberately permitted in the bending area of the side bands, without, however, these enlarging the overall width of the hollow section in the bending area and thereby making the spacer frame unusable.

It is suitable for the floating or movable or swinging mounting of the abutment (which makes an adaptation of its position between support and hold-down clamp possible) if the abutment is impinged upon on one side, especially on the side of the support, or in the use position on its underside, by a compression spring or the like, in the sense that it is kept at a distance from the support when the hold-down clamp is raised. Above all, with a horizontal arrangement, the aforementioned compression spring thus acts against gravity and raises the abutment, so that when the hold-down clamp is raised, the abutment can also raise a previously bent section or support such a lifting movement. If at the same time the abutment is pivotable about an axis, it can protrude in relation to the axis toward the side facing the actual abutment side and with this projection exert an impact which restricts the pendulum movement. For example, the projection could be inclined so that the part of the abutment projecting over the swivel bearing comes to the support when the spring raises the abutment in the bending area.

The rotatable part of the hold-down clamp and the abutment can be joined with each other, especially be joined in one piece. A synchronous and even as well as simultaneous movement of the hold-down clamp as well as of the rotatable part is thereby possible, so that the inner side of the bend, on the one hand, but also at least the inner side of the side band, on the other hand, are to a certain extent pulled and guided along by the parts impinging upon them. Relative movements between abutment and hold-down clamp, which could lead to corresponding squeezing on the hollow sections and its bands, are avoided. This is, however, also possible if the rotatable part of the hold-down clamp and the abutment are not connected with each other, but these elements or elements containing them have a common drive.

The abutment can have traversely running grooves distributed over its abutment surface, engaging on the inner cross band of the hollow section, for engaging bands projecting inwardly on the hollow section, and the number of grooves can in particular be selected such that several hollow sections of varying but common width with inwardly projected bands can be impinged upon. The abutment can thus be configured similar to the bending mandrel used as an abutment in accordance with EP-B-0 582 064, at least in the area of its actual abutment surface from where the abutment can, however, be continued to its mounting. It suffices if the abutment surface of the abutment having a partial circle-shape cross-section has the aforementioned spaced grooves between the support and the hold-down clamp, which can correspond to the ring grooves of the known bending mandrel in accordance with EP-B-0 582 064 with respect to their function.

Consequently, hollow sections of various width, whose side bands are extended beyond an inner side cross band, can be grasped and bent by the apparatus of the invention because the projecting side bands can engage in the grooves of the abutment, wherein expediently a groove aligns with the support or coincides with it, and the further grooves set at a distance thereto are so proportioned in their distances to this first groove coinciding with the support, that sections of various widths can be grasped.

In an expedient manner, the respective outer wall of a groove grasping a hollow section with a band can, in addition, form the rotatable part of the hold-down clamp, that is, engage the grooves of the support set at a distance with their inner-lying wall on the inner side of the band, while the outer wall comes to lie on the outer side, and can there exercise the function of the rotatable element of the hold-down clamp, which in this case is joined as one piece with the abutment. Consequently, sections of this type of varying width can be grasped by one and the same abutment and are impinged upon and processed with a co-rotatable element of a hold-down clamp in accordance with the invention.

Furthermore, it can be expedient if the abutment is releasably and interchangeably fastened. This permits not only a rapid repair, since a damaged abutment can be replaced, but abutments with different dimensions can also be inserted which of course then goes along with a corresponding resetting of the distance between hold-down clamp and support. Sections with widths of various dimensions can also be processed thereby.

The stationary part of the hold-down clamp and its mounting can overlap the section to be bent from the outer side of the bend to be formed. This results, above all, in a small space requirement on the inner side of the bending point and the subsequent bending, so that even angles smaller than 90° can be bent without difficulty, without being hindered in this connection by the mounting and arrangement of the fixed element of the hold-down clamp. The leg to be bent can thereby thus then be bent more than 90°, for example up to approximately 140°, which finally leads to a correspondingly acute and considerably smaller angle than 90° between the two legs of the hollow section.

For a secure grasping, above all of the leg of the hollow section to be bent, it is beneficial if a mounting is arranged in the area of the setting device for the supplied section before the bending area, opposite which the hold-down clamp projects into the bending area, and if the rotatable part of the hold-down clamp carries on this projecting part a leg impinging upon the bending area, which is co-swivellable with the bending movement during the bending operation, which is fastened on a bending tool executing the bending movement of the leg of the hollow section to be bent, and in particular is mounted movably relative thereto in a transverse direction or in the direction of raising the hold-down clamp away from the section. The rotatable element of the abutment is thus continued into a leg, which grasps the appropriate part of the side band of the hollow section on the leg to be bent, and protects against unwanted deflections and maintains the exact distance from the opposite-lying side band. At the same time, the bending movement is transferred to the rotatable element of the hold-down clamp by this connection between bending tool and rotatable part of the hold-down clamp through the co-swivellable hold-down clamp leg, thus realizing the even and simultaneous movement of these parts.

The rotatable part of the hold-down clamp can thus continue in the direction of extension of the bendable leg of the hollow section, grasping this adjacent to the bending point, whereby then this continuation forms the already mentioned hold-down clamp leg. This has a double function, since it, on the one hand, acts as hold-down clamp and, on the other hand, as a coupling or transmission of the swivelling motion of the bending tool to the rotatable element of the hold-down clamp, with which it can be connected in one piece.

It should also be mentioned that the rotatable element of the support can be a rotation plate sloping radially outward, whereby this outward incline naturally takes place at a very small angle, so that inserting and loading the workpiece or hollow section between support and hold-down clamp is as simple as possible, even when the hollow section has side bands which extend flange-like beyond the inner-lying cross band, and define a U-shaped hollow space on the inner side of the cross band.

Overall, there results a bending apparatus with which hollow sections having very thin walls on the order of magnitude, for example, of only about 0.1 mm to about 0.2 mm, or also those of steels, which sometimes can only be deformed with difficulty, can be bent, whereby the dimensional accuracy between the side bands can be precisely maintained even in the bending area, because the hold-down clamp is subdivided and a rotatable part of this hold-down clamp is installed in the area of the side band which is most strongly deformed, the rotation of which supports the flow of the material around the bend and in any case hinders it as little as possible. At the same time, that the section is indeed guided and held in the area in front of the bending (but is not so firmly clamped that no material can be pulled along from this area) contributes to a favorable flowing and deformation behavior on the side bands. Furthermore, the floating arrangement of the abutment, which engages the section between support and hold-down clamp, is of great significance, and indeed either between bands projecting in relation to a cross band or, with adjusting the inner-lying band to a neutral axis in connection with a somewhat boxlike section and dipping between the side bands, partially folding around these, as is known from EP-B-0 318 748, for example.

Through the previously described features and measures, allowance is made not only for the necessary deformation at the cross bands, but also at the side bands.

BRIEF DESCRIPTION OF THE SEVERAL VIEWS OF THE DRAWING

Embodiments of the invention are described in detail below on the basis of the drawings. There are shown in partially schematic representation.

DETAILED DESCRIPTION OF THE INVENTION

In the various embodiments described hereafter, parts corresponding in their function receive corresponding reference numbers, even when they have a different configuration from each other.

Figure 1:
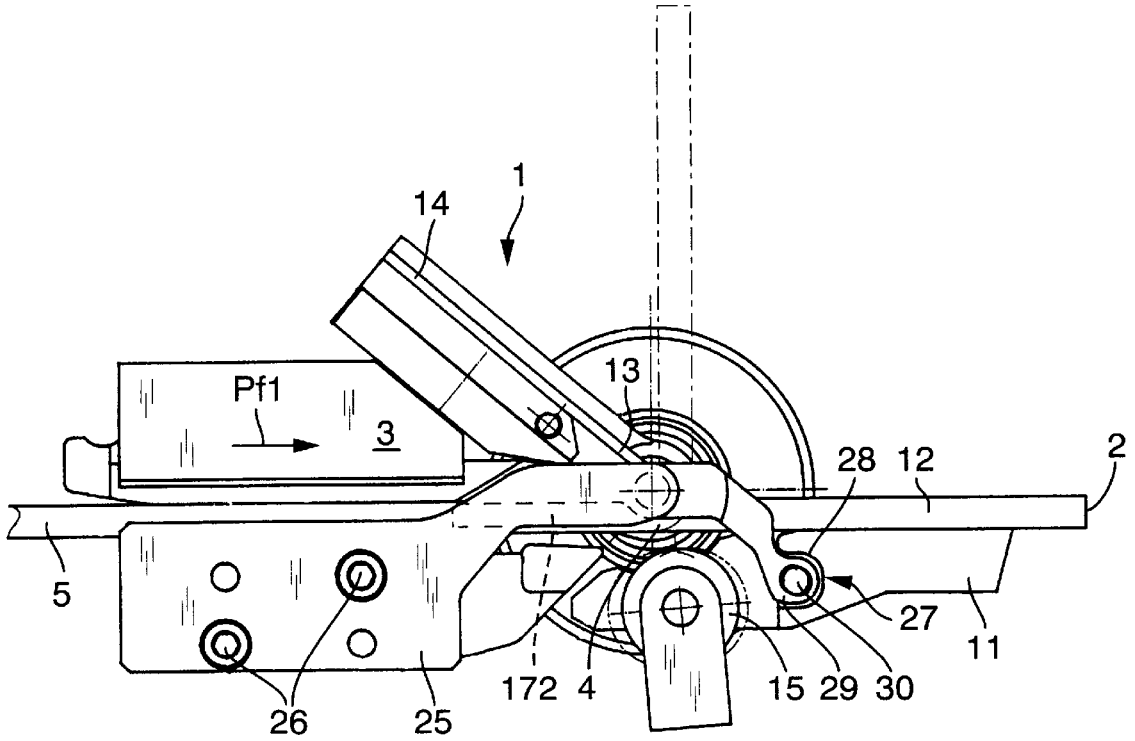
FIG. 1 is a view of an apparatus of the invention for bending a hollow section, wherein the hollow section is already in the bending position and the guide and holding device for this hollow section, on the one hand, and a facility acting as bending tool for grasping and swinging the leg to be bent and an abutment interacting therewith, on the other hand, are still in the open position.
Figure 2:
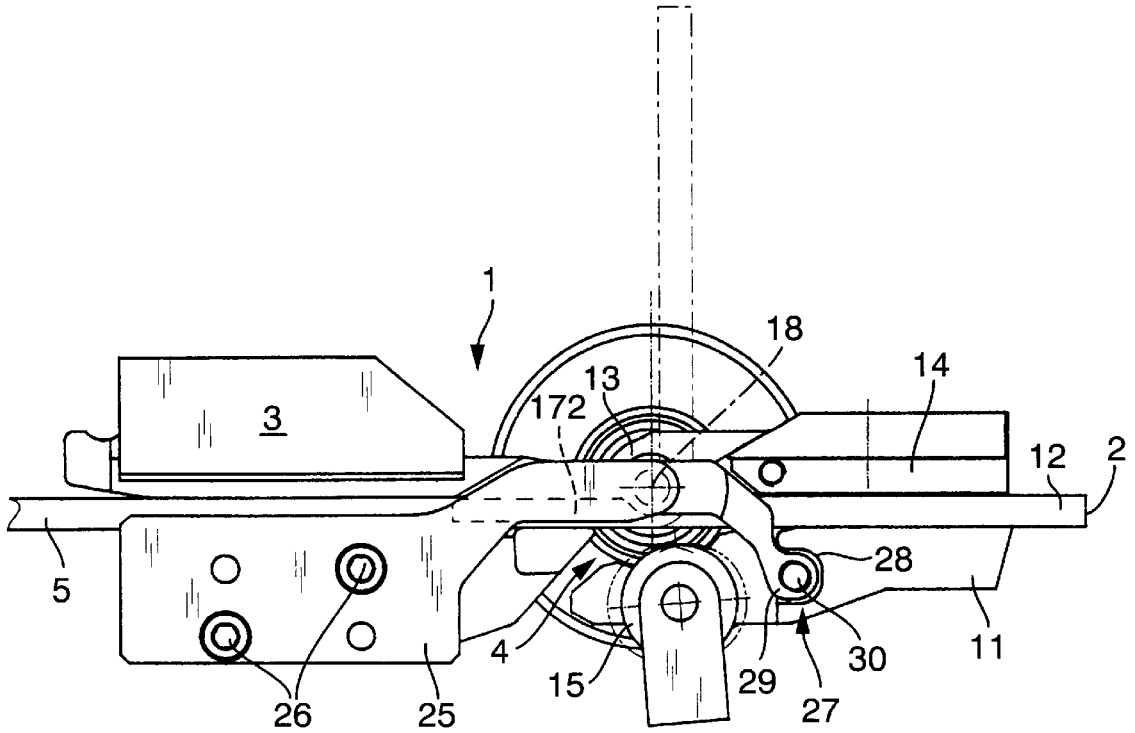
FIG. 2 is a representation corresponding to FIG. 1, in which the hollow section to be bent is grasped in front of the bending point by the holding device and behind the bending point by the bending tool, wherein the abutment which is swivellable in the direction of bending during the bending process is also in the starting position and, with a continuation leg, lies on the inner side of the leg grasped by a bending beam of the bending tool on its outer side.

A bending apparatus, designated as a whole with 1, for bending a hollow section 2, which, for example, is to be used for producing a hollow spacer frame for insulating glass sheets, hereinafter also referred to in short as "bending apparatus 1," has a guide and holding device 3 lying and arranged in approximately the feed direction of the hollow section 2, with which the profile region 5 in front of the bending point 4 can be grasped, and is grasped in accordance with FIG. 2. The feed direction of the section is thereby indicated with the arrow Pf1 in FIG. 1.

Figure 7:
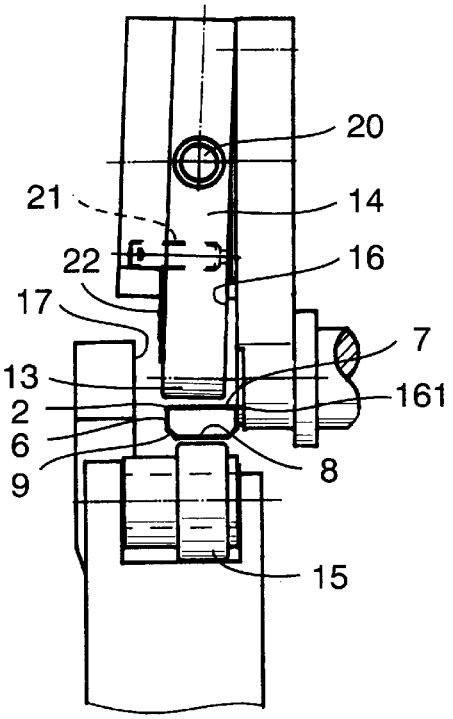
FIG. 7 is a modified embodiment of the apparatus for bending analogous to the representation in FIG. 5, wherein the hold-down clamp and the remaining parts of this apparatus are in the open position and a roller dipping into the hollow section on the outer side of the bending point during bending is provided, and where owing to the open position and the associated lifting of the hold-down clamp, the abutment with its continuation leg is raised in relation to the support or is somewhat swivelled away from it.
Figure 12:
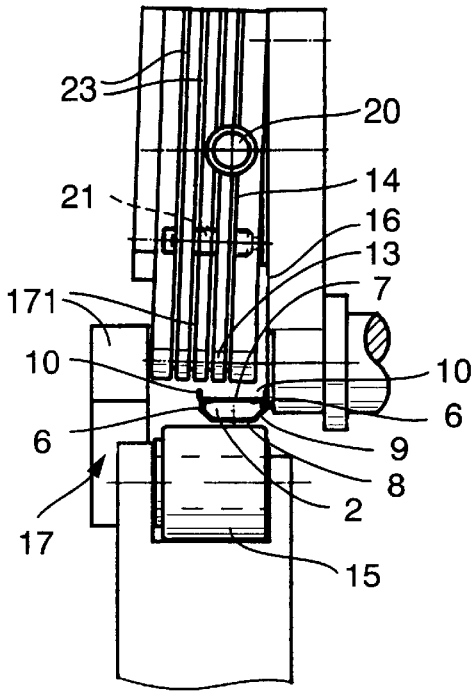
FIG. 12 is an end view corresponding to the representation of FIG. 7 of the modified bending apparatus in accordance with FIG. 11 with a view of the abutment and of the grooves provided there for adaptation to hollow sections of varying width, wherein the outer side of the bending point can be impinged upon by a compression roller, whose width is larger than that of the hollow section.
Figure 16:
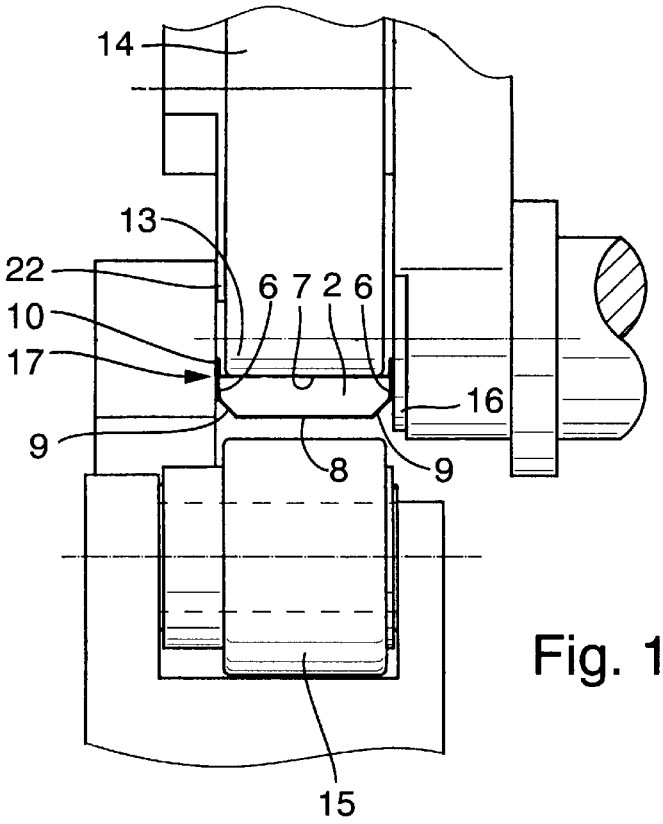
FIG. 16 is a view in enlarged scale, corresponding to FIGS. 5 and 7 to 10 as well as 12 to 15, of a modified embodiment, in which the dimensioning of the abutment has a smaller breadth in relation to the inner side of the hollow section or leg projecting inwardly there, and allows a defined play in the starting position, which is filled by the transformation.

One recognizes varying or possible cross-sectional shapes of the hollow sections 2, for example in FIG. 7, FIG. 12 and FIG. 16. In this connection, FIG. 7 shows an approximately box-shaped cross section, in which two parallel side bands 6 and two parallel cross bands 7 and 8 running approximately at right angles thereto are provided, wherein the inwardly lying cross band 7 in the bending area and at the bending point 4 directly joins the side bands 6 at right angles, while the outwardly lying cross band is connected with the side bands via oblique transitions 9.

With hollow sections in accordance with FIG. 12 or 16, the side bands 6, viewed in cross section, have flanges 10 projecting beyond the inwardly lying cross band 7, so that the inwardly lying cross band 7 lies closer to the neutral axis of the hollow section 2 or can even be arranged in the neutral axis. The flanges 10 at the bending point 4 are located on the inside of the bend, and their cross section is directed toward the inside of the bend.

Figure 3:
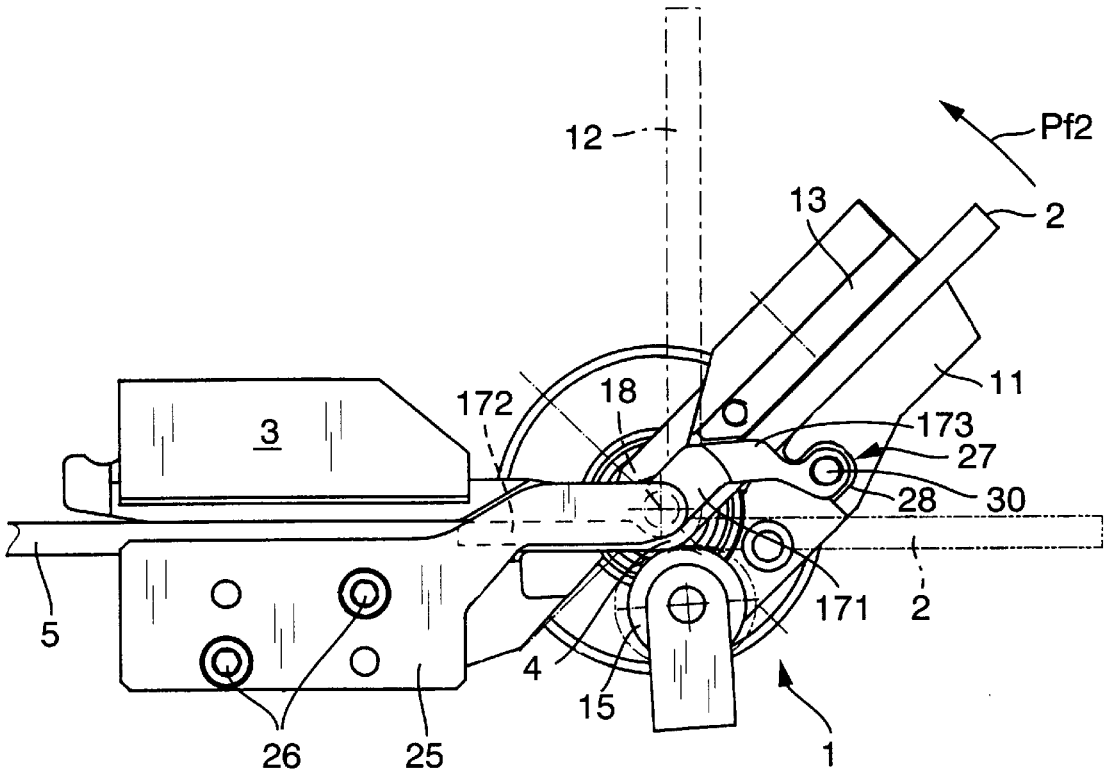
FIG. 3 is a representation corresponding to FIG. 2 during the bending operation, after the bending tool and the abutment as well as a rotatable part of a hold-down clamp have executed a swivelling of about 45°.
Figure 4:
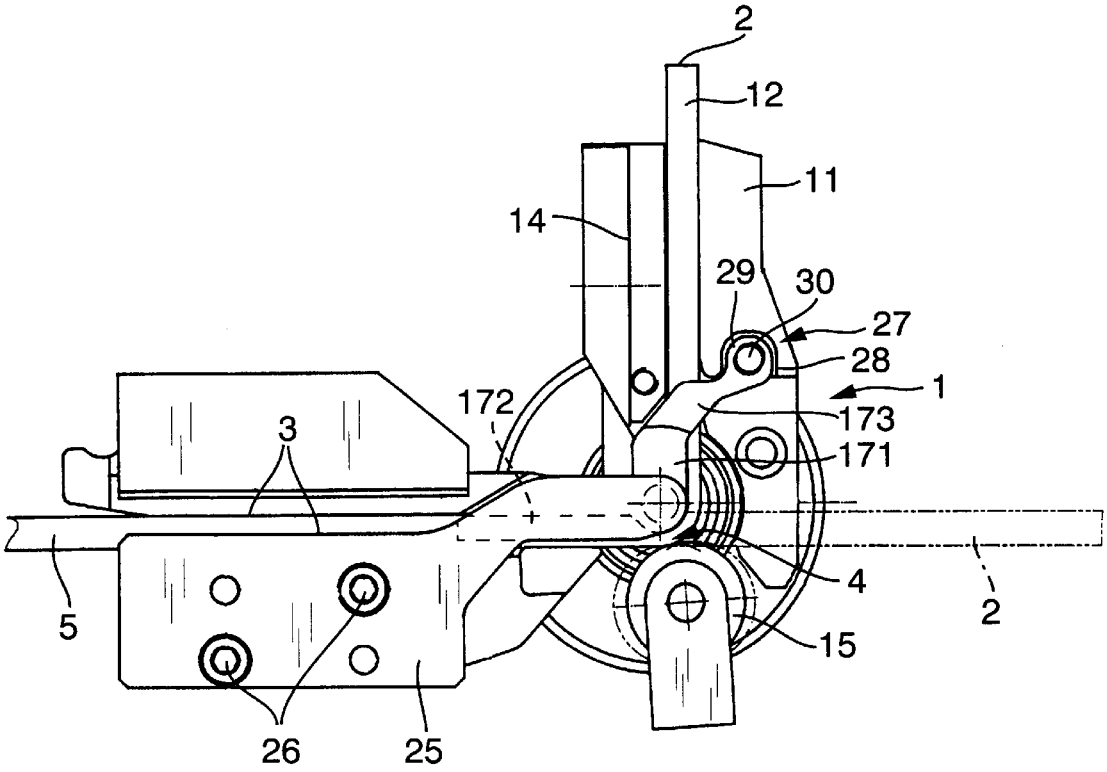
FIG. 4 is a representation corresponding to FIGS. 2 and 3, in which the hollow section is bent 90°.
Figure 5:
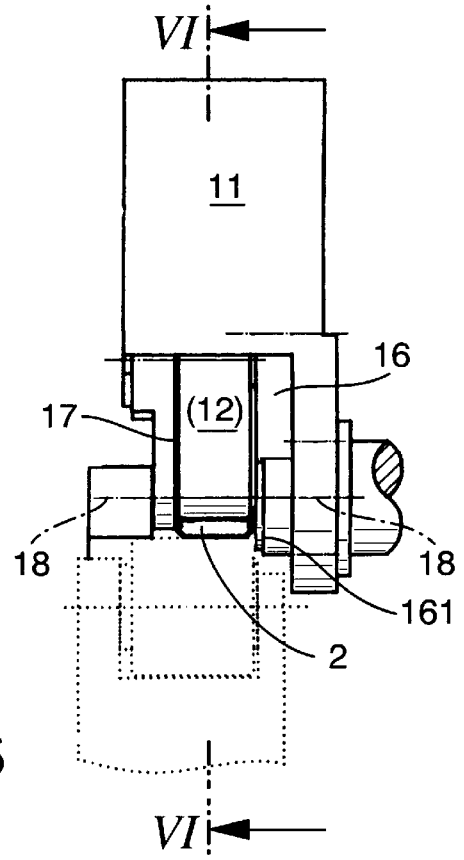
FIG. 5 is an end view of an apparatus of the invention with the abutment, a support for the hollow section and an outer side-engaging hold-down clamp, wherein at the same time a roller acting upon the outer side of the bending point is indicated in dotted lines.
Figure 6:
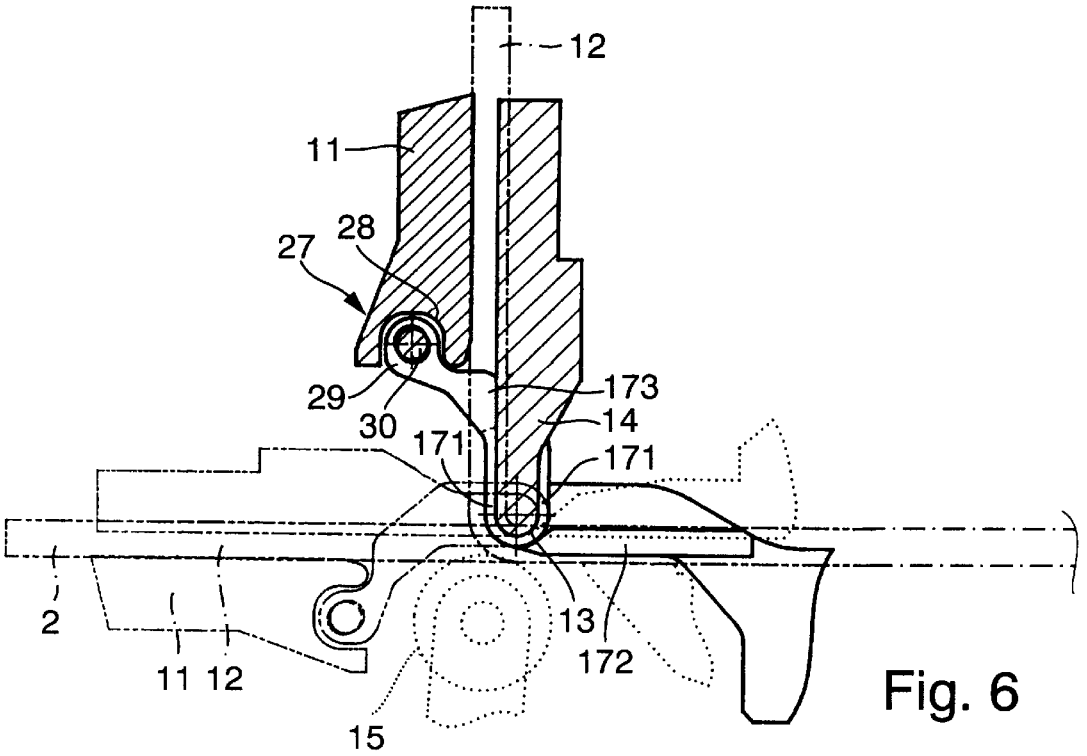
FIG. 6 is a cross section of the bending apparatus and especially the abutment and the bending beam along section cutting line VI—VI of FIG. 5 with a view of the surface of the hold-down clamp acting upon the hollow section to be bent, and thereby of a stationary part of the hold-down clamp, as well as of a swivellable or rotatable part of this hold-down clamp.
Figure 9:
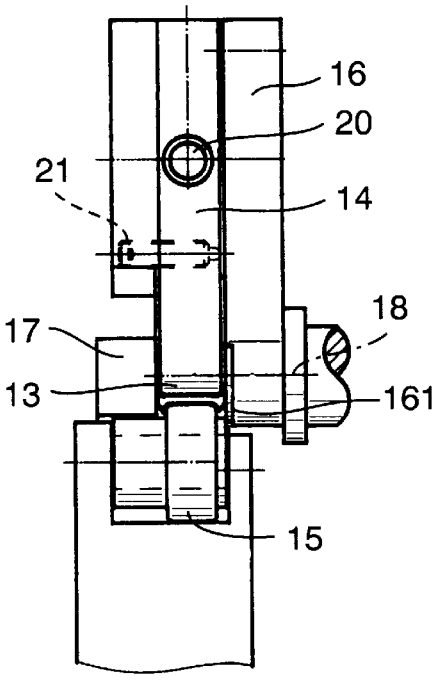
FIG. 9 is a representation in accordance with FIG. 8 at the end of the bending process, during which the abutment, on the one hand, and the impression roller acting upon the outer side of the bending point, on the other hand, have dipped into the hollow section at its bending point.
Figure 11:
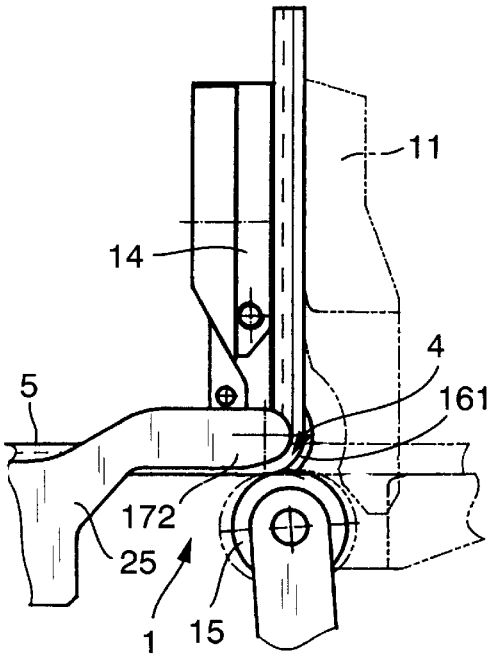
FIG. 11 is a view of a modified bending apparatus in which the rotatable element of the hold-down clamp is joined with the abutment as one piece, that the abutment has grooves running transverse to its abutment surface, wherein the respective wall facing away from such a groove acts as a rotatable element of the hold-down clamp.

The individual parts of the bending apparatus 1 are suitably adapted to this hollow section 2 in order to be able to hold it fast and bend it. For this purpose, one also recognizes chiefly in FIGS. 2 to 6 and furthermore in FIG. 11 a device, designated as a whole with 11, acting or serving as a bending tool for grasping and swivelling the leg 12 of the hollow section 2 to be bent, therefore also referred to hereinafter as "bending tool 11." Furthermore, the bending apparatus 1 includes an abutment 13, which is similar to the abutment known from EP 0 318 478 B1 with respect to form and mode of action. Besides this, the abutment 13 has a continuation leg 14 originating from its actual abutment surface, which during bending joins in the swinging-bending movement running in the direction of the curved arrow Pf2 recognizable in FIG. 3. The inner side of the resulting bending or curvature is thereby fixed with the abutment 13, whereby the directly impinged cross band 7 can optionally be moved and deformed in direction toward the neutral axis, as indicated in FIG. 9, if at the same time the abutment 13 dips into the hollow section 2 between the side bands 6 at the bending point 4, namely during the bending movement.

Moreover, in the embodiments yet another tool is provided in the form of a pressure roller 15, which is movable on the outer side of the bending point 4 during tightening relative to the abutment 13 and to the hollow section 2, and pressable against the outer side and the outer-lying cross band 8 of the hollow section 2 (FIG. 5 and FIGS. 12 to 15), or dipping between the side bands 6. This is known from EP 0 121 873 B1 and from EP 0 318 748 B1, respectively, with respect to form and mode of operation and action.

As is likewise known from the publications already mentioned several times, the bending apparatus is also provided with a support 16 for a side band 6 or an area of the side band 6 of the hollow section 2, and parallel to this a hold-down clamp, designated generally by 17, for the other parallel side band 6, or a part of this other side band 6 of the hollow section 2 is provided, wherein the distance between the hold-down clamp 17 and the support 16 during the bending operation (for example, in accordance with FIG. 5 or 16) corresponds approximately to the width of the hollow section 2, and thus to the subsequent clearance between two glass sheets of insulating glass to be kept apart.

Figure 8:
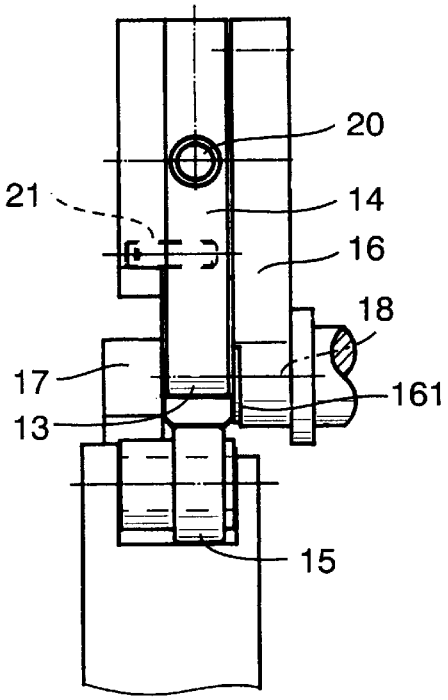
FIG. 8 is a representation corresponding to FIG. 7 at the beginning of the bending operation, thus an end view approximately of the arrangement in accordance with FIG. 2.
Figure 13:
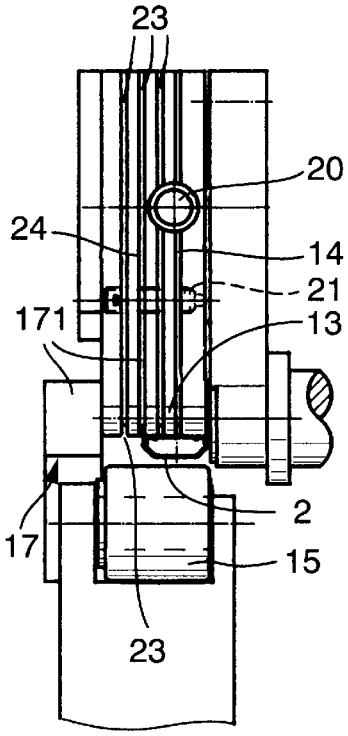
FIG. 13 is a representation corresponding to FIG. 12 with the apparatus closed at the beginning of the bending operation.
Figure 14:
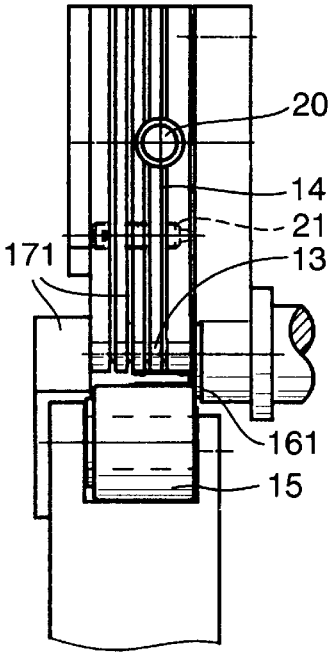
FIG. 14 is a representation of the apparatus corresponding to FIGS. 12 and 13, analogous to FIG. 9, at the end of the bending operation.

For example, it becomes clear from FIG. 8 or 16, or even from FIG. 13, that in this way the hollow section 2, at least at the bending point 4, is enveloped and enclosed on all sides to the greatest extent at the beginning and during the bending movement, so that measurement deviations owing to uncontrolled deformations are avoided, above all on the side bands 6, which later form the installation surfaces for the glass sheets and should there present a smooth, good-sealing surface, wherein under some circumstances areas of this side band 6 can be coated with a sealing compound even before conducting the bending.

The bending operation is thus supported on the inner-lying cross band 7 in that the abutment 13 and its continuation leg 14 are co-swivelled synchronously with the bending motion in accordance with the arrow Pf2. Furthermore, in the embodiments the bending operation is supported on the outer-lying cross band 8 by a compression roller 15, which either exceeds this outer-lying cross band 8 in width and has a rolling and stretching action (FIG. 5 and FIGS. 12 to 15) or which, owing to its small dimensions, can thereby dip between the side bands 6 (FIGS. 7 to 10 and FIGS. 16 and 17, as known from EP 0 318 748 B1).

In addition, with the apparatus 1 the bending motion and the necessary material deformation of the substance of the hollow profile 2 are thereby supported in that (as is clearly recognizable, for example, in FIG. 6) the hold-down clamp 17 is subdivided, and an element 171 of the hold-down clamp situated in the bending area 4 (hereinafter also referred to as the rotatable hold-down clamp element 171) is rotatable in the bending direction, at least around the bending angle, wherein the swivelling or rotating axis 18 for this rotatable element 171 of the hold-down clamp is arranged approximately through the neutral axis of the hollow section 2 to be bent or radially displaced in relation to this toward the inner side of the bend, as the embodiments illustrate it.

Since the hold-down clamp 17 is subdivided, there is in addition an element 172 of the hold-down clamp located in the feed direction of the hollow section 2 before this rotatable element 171 and before the bending point 4, which is stationary and which impinges upon the part of the hollow section 2 held unmoved during the bending operation and holds it down immediately adjacent to the bending point 4.

Owing to this swivelling or rotating movement of the rotatable hold-down element 171 and the interaction with the mounting of the hollow section 2 on the holding device 3, allowance is made for deformation and movement, as well as the requisite flow of the material of the hollow section 2, as best as possible even in reference to the side band 6. Thus, this deformation and movement is supported not only on the inner-lying cross band 7 and on the outer-lying cross band 8, respectively, but also the cross band 6 is taken along in a suitable manner with reference to its deformation "around the corner" by the thereby co-rotating element 171 of the hold-down clamp 17 and deflected in the desired direction.

In the embodiment, the rotation axis 18 for the co-rotating element 171 of the hold-down clamp coincides with the swivelling axis of the bending tool 11, for which reason the rotation axis 18 and this swivelling axis are provided with the common reference number 18. A synchronous rotating movement of the rotatable element 171 of the hold-down clamp with the bending movement is thereby provided in accordance with the arrow Pf2.

Even the support 16 for the hollow section 2 to be bent has a co-rotatable element 161 in the bending area 4, whose rotation axis again aligns or coincides with that of the co-rotatable element 171 of the hold-down clamp 17, wherein this rotation axis 18 of the co-rotatable elements 161 and 171 is arranged at right angles to the hold-down clamp surface and the support surface, and thereby at right angles to the side bands 6 of the hollow section 2. One clearly recognizes this, for example, in FIGS. 8 and 9, 13 and 14, as well as 16 and 17.

Since the material of the hollow section 2 and thereby also that of the side bands 6 must be moved and drawn somewhat around the "bend" during the bending operation (thus some material should also be able to afterflow from the hollow section area before the bending point 4), the stationary element 172 of the hold-down clamp 17 has a small play or a sliding fit in relation to the hollow section 2 to be bent (meaning that its distance from the support 16 can be slightly larger than the corresponding dimension of the hollow section 2), wherein, however, it is a matter of a barely ascertainable play in the range of hundredths and tenths of millimeters. The hollow section 2 is thereby also sufficiently secured by the holding device 3, and nonetheless allows the desired minor afterflow of material situated directly in front of the bending point 4 into the bending area. Furthermore, the holding device 3 can still have a holding jaw 19, at first open according to FIG. 1 and pressable against the outer-lying cross band 8 according to FIG. 2, which makes a good securing of the hollow section 2 possible, despite the mentioned play in the area of the stationary element 172 of the hold-down clamp 17.

The workpiece constructed as a hollow section 2 is kept play-free and/or clamped in the feed direction behind the bending area 4 between hold-down clamp 17 and support 18 and in the bending tool 11 serving to grasp the leg 12 to be bent, so that its dimensions are not altered by the bending operation. For this purpose, the co-swivellable or co-rotatable element 171 of the hold-down clamp 17 and the co-rotatable element 161 of the support 16 become effective in this area. The hollow section 2 is thus firmly and securely grasped on all sides on and behind the bending point 4, so that its cross section and especially the spacing of the outer sides of the side bands 6 remain preserved during and after bending.

Figure 10:
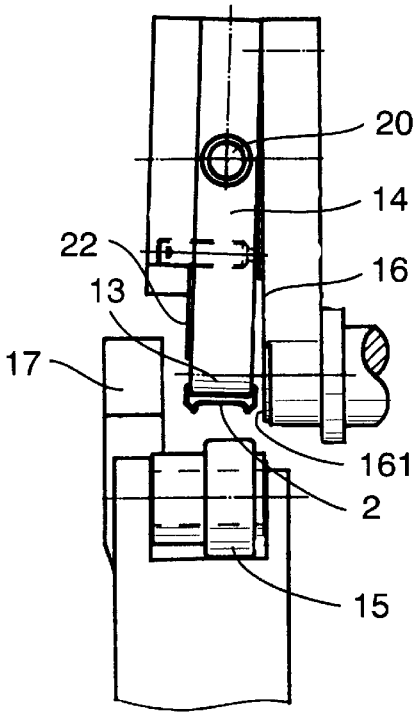
FIG. 10 is a representation corresponding to FIGS. 7 to 9, wherein the apparatus has opened again following the bending operation, and the abutment with the section has been lifted from the support.

One recognizes an essential particularity of the apparatus 1 in its various embodiments in FIGS. 7 and 10, on the one hand, as well as 12 and 15 on the other hand. The particularity consists thereby in that, in the figures mentioned respectively, the abutment 13, variously configured in a manner yet to be described, is mounted deflectably and thereby swinging transverse to its longitudinal extension and to the longitudinal extension of its continuation leg 14 in such a manner that its range of action (thus the part of the abutment 13 which impinges upon the inner-lying cross band 7 during the bending motion, and under certain circumstances is also somewhat deformed into the interior of the hollow section 2) is movable back and forth between the support 16 and the hold-down clamp 17 or rotatable element 171 of the hold-down clamp. The aforementioned figures thereby show the respectively largest deflection with the open or unused bending apparatus 1, in which the hold-down clamp 17 is still shifted away from its operating position and is raised. This greatest deflection motion is partially reversed by the placement of the hold-down clamp in its position represented in FIGS. 8 and 9, 13 and 14, as well as 16 and 17, and also in FIG. 5. However, a certain automatic adaptability to measurement inexactitudes or minor material fluctuations of the hollow section 2 and its side bands 6 or even its flange 10 remains preserved.

The automatic adaptation and centering of the abutment 13 takes place here through the already mentioned pendulum motion about a transverse axis 20, which penetrates the continuation leg 14 at a distance to the actual abutment 13 in the transverse direction and thereby also at right angles toward the rotation axis 18.

Figure 15:
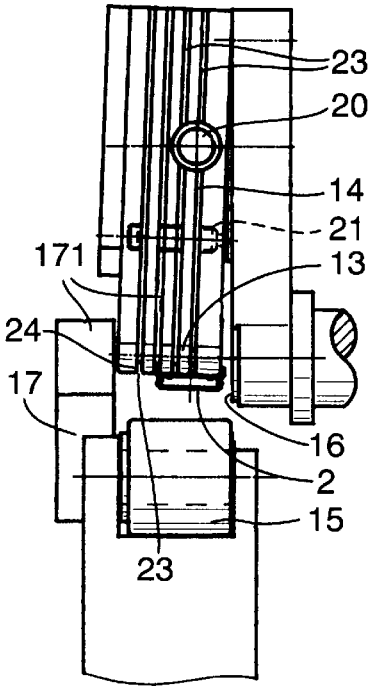
FIG. 15 is a view in accordance with FIGS. 12 to 14 and analogous to FIG. 10 at the end of the bending operation after the opening of the apparatus.

FIGS. 10 and 15 moreover make clear a further advantage of this swinging arrangement of the abutment 13. After the bending operation this swinging motion into the deflected position namely also supports the raising of the bent hollow section 2 from the support 16, so that it can be removed relatively easily from the bending apparatus device 1, despite its deformation and a consequent squeezing accompanying it. The swinging arrangement of the abutment 13 thus also supports the ejection of the bent hollow section 2. This measure consequently has a double function because it on the one hand permits an automatic adaptation to possible minor irregularities of the hollow section 2 at first during the placement and during the bending operation, and on the other hand facilitates the removal of the bent workpiece from the bending apparatus 1.

It is provided in the embodiment that the abutment 13 is impinged upon on one side (in this case on the side of the support 16) by a compression spring 21, in this case by a pin interacting with the compression spring 21, in the sense that it is held at a distance from the support 16 when the hold-down clamp 17 or the hold-down clamp element 171 is raised, as shown in FIGS. 7 and 12. The compression spring 21 thereby swings the abutment 13 around the transverse axis 20 into the deflected pendulum position. At the same time, this deflection is restricted by the fact that the part of the continuation leg 14 projecting over the transverse axis 20 comes to lie on the support 16 or a continuation thereof, and prevents a further swivelling. The abutment 13 and especially its continuation leg 14 is thus configured as a rocker. The alignment of the abutment 13 in the operating position takes place through resetting the hold-down clamp 17 or 171 in the use position in accordance with FIG. 8 or 13 or 16 against the force of the spring 21, which becomes effective again following the bending operation and after raising the hold-down clamp 17 then in accordance with FIG. 10 and 15, and assists in separating the bend hollow section 2 from the bending apparatus 1.

Figure 17:
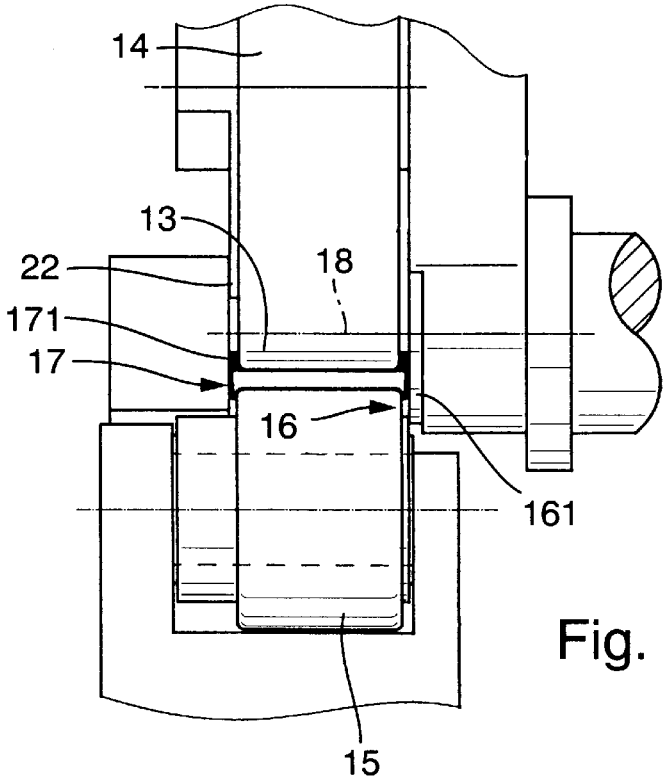
FIG. 17 is a representation corresponding to FIG. 16 during and after the bending operation, after which the play between abutment and hollow section is also filled out on the surfaces of the abutment by transforming the hollow section or its projecting leg.

FIGS. 16 and 17 show still another modification in connection with the bending of a hollow section 2, in which the inner-lying cross band 7 is overhung by the flanges 10 extending from the side bands 6. In this case, a defined play exists in accordance with FIG. 16 between the inner sides of theses flanges 10 and the abutment 13, respectively, which can be filled in by the reformation in accordance with FIG. 17. Even here, the co-rotatable element 171 of the hold-down clamp and the co-rotatable element 162 of the support act correspondingly with and prevent a measurement deviation of the side bands 6 and the flanges 10 toward the outside, whereby, however, deformations eventually necessary owing to the bending, above all of the flanges 10, find space in the area of play already mentioned.

Besides, one recognizes that a spacer 22 (appropriately in one piece with the abutment 13) can be provided on the surface of the abutment 13 or its continuation leg 14 facing the hold-down clamp 17, in order to leave space for the leg or flange 10. Such a spacer 22 can, however, also be provided with the embodiment in accordance with FIGS. 1 to 10, especially when the abutment 13 and optionally also the pressure roller 15 dip into the hollow section 2 at the bending point 4. An abutment 22 of this type is accordingly also indicated in FIGS. 7 and 10.

In the embodiments in accordance with FIGS. 1 to 10, as well as 16 and 17, the rotatable element 171 of the hold-down clamp 17 is independent of the abutment 13, and can be lifted relative to the abutment 13 in the direction of the rotation axis 18.

In contrast, in the embodiment in accordance with FIGS. 11 to 15, a modification is provided such that this rotatable element 171 of the hold-down clamp 17 and the abutment 13 are joined with one another, and indeed in one piece in this embodiment. This has the advantage that the synchronous motion of the abutment 13 and the rotatable or swivellable element 171 takes place automatically. Moreover, a configuration of the apparatus 1 is possible, which is also realized in this embodiment, and which consists in that the abutment 13 has transversely running grooves 23 distributed over its abutment surface for flanges 10 projecting inwardly on the hollow section 2 or for folds of the side bands 6, and that the number of the grooves 23 is selected such that several variously dimensioned hollow sections 2, with bands 6 or flanges 10 projecting inwardly already before or first after the bending, can be impinged upon. In FIGS. 12 to 15, a hollow section 2 is moreover illustrated with flanges 10 of average dimension projecting beyond the inner-lying cross band 7 from the start. One recognizes that even narrower hollow sections 2 or even a wider hollow section 2 can be processed.

The respective outer wall 24 of a groove 23 grasping a hollow section 2 with a band 6 or a flange 10 thereby forms the rotatable element of the hold-down clamp 17, which is clear in the figures mentioned. For such an outer wall 24 overlaps in the operating position at least an area of a flange 10 constructed at the same time as a side band, and also synchronously follows the bending motion and the swivelling of the abutment 13 and its continuation leg 14 around the rotation axis 18 executed thereby. Moreover, a stationary element 172 of the hold-down clamp 17 is provided in front of the bending point 4 in accordance with FIG. 11.

Of course, an abutment 13 could nonetheless also be provided with only one groove, wherein then the outer wall 24 of this groove would form the one-piece co-rotatable element 171 of the hold-down clamp 17 for a specified dimension of the hollow section cross section.

It should be mentioned at this point that the abutment 13 can be fastened separably and interchangeably. Since the hold-down clamp 17 or another lock is displaceable in the direction of the rotation axis 18, an adaptation to variously proportioned cross sections of hollow sections 2 can likewise be conducted in this way. An abutment in accordance with FIGS. 1 to 10 or in accordance with FIGS. 11 to 15 can even be used electively.

In order that sufficient space remains even for an overbending or for the swivelling of the bending tool 11 over more than 90°, for example up to about 140°, on the innner side of the bending point 4 and in the swivelling area of the abutment 13 and its continuation leg 14, thus in the interior of the bend, the stationary element 172 of the hold-down clamp 17 and its mounting 25 overlap the hollow section 2 to be bent from the outside, as one clearly recognizes in FIGS. 1 to 4 and 11. Consequently, the mechanism for lifting the hold-down clamp 17 can be well accommodated, from which one recognizes guide rods 26 in the aforementioned FIGS. 1 to 4.

In the area of the setting and holding device 3 for the supplied hollow section 2 before the bending area or the bending point 4, the already mentioned mounting 25 is thereby arranged on the outside, in relation to which the hold-down clamp 17 projects into the actual bending area. The rotatable element 171 of the hold-down clamp 17 at the same time carries a hold-down clamp leg 173 impinging directly upon the bending area 4 and co-swivelling with the bending motion during the bending operation, which is indeed fastened on a bending tool 11 executing the bending movement of the leg 12 of the hollow section 2 to be bent, and thus is also carried along in accordance with FIG. 3, in a transverse direction thereto (vertical to the drawing plane of FIG. 1 to 4), but is mounted movably in order to permit the lifting motion already mentioned. One recognizes this coupling or connection point 27 in the plan views of the apparatus 1. Accordingly, the bending tool 11 has a recess 28, into which a protrusion 29 of the hold-down clamp leg 173 engages. Moreover, in the coupling area 27 a guide pin 30 arranged parallel to the rotation and bending axis 18 and to the guide rods 26 can be recognized, which supports the already mentioned lifting motion vertical to the drawing plane of FIGS. 1 to 4 and relative to the bending tool 11.

Consequently, the rotatable part 171 of the hold-down clamp 17 continues in the direction of extension of the bendable leg 12 of the hollow section 2, grasping this adjacent to the bending point 4, through this hold-down clamp leg 173. The side bands 6 or flanges 10 are hence grasped directly at the bending point 10 (sic 4), as well as therebehind in the feed direction in accordance with arrow Pf1, and thereby synchronously held down with the bending advance.

It should still be mentioned that the rotatable element 161 of support 16 can be a radially outwardly inclining rotation plate, which can facilitate fitting in and inserting the hollow section 2 between the hold-down clamp 17 and support 16.

Overall there results an apparatus 1 in which the material of the hollow section 2 with respect to its flowing behavior is supported (and in any case is not disturbed) during the bending operation even at the side band 6 and/or flange 10 impinged upon by the hold-down clamp 17, so that an unwanted upsetting and a deformation impairing the outer dimensions and the sealability is avoided even on this side surface of the section 2. The entire bending process is harmonized and supported, not only at the cross bands 7 and 8, but also at the side bands 10, by appropriate synchronization motions with the aid of the rotatable element 171 of the hold-down clamp 17. The rotation of the rotatable hold-down clamp element 171 takes place, moreover, in the embodiments by the swing drive for the bending tool 11 and/or for the hold-down clamp 17, so that a synchronous motion takes place for the entire bending operation.

An apparatus (1) serves to bend a hollow section (2) with which a spacer frame for insulating glass sheets is to be manufactured. For this purpose, the hollow section (2) can already be filled with drying agent during bending or, however, still be empty. The bending apparatus also has, in addition to a bending tool (11) and an abutment (13), a hold-down clamp (17) for impinging upon a side band (13) (sic 6) and/or a flange (10) whose cross section continues internally, and parallel thereto a support (16), so that the external proportions of the hollow section (2) remain precisely preserved even in the bending area (4). In order to support thereby the bending motion and the deformation, as well as the flow of the material of the hollow section (2) and its side bands (6)/flanges (10), the hold-down clamp (17) is subdivided and has an element (171) co-rotatable with the bending motion in the bending direction, which supports the change of direction of the side band (6)/flange (10) during the bending operation.

I claim:

1. Apparatus (1) for bending a hollow section (2) having a leg to be bent for manufacturing a hollow spacer frame, filled during or after bending with drying agent, for insulating glass sheets, the apparatus comprising a guide and holding device (3) arranged approximately in a feed direction of the hollow section (2) for grasping a section area (5) of the hollow section situated before a bending area (4), a bending tool (11) for grasping and swivelling the leg (12) of the hollow section (2) to be bent, and an abutment (13) for fixing an inner side of a resulting bend, and having a tool movable on an outer side of the bending area (4) under contact pressure relative to the abutment (13) and the hollow section (2) and at least one of pressable on the outer side of the hollow section (2) and dipping between side bands (6) of the hollow section (2), impinging upon at least one part of the section situated on the outer side of the bending area, wherein a support (16) is provided for at least a portion of one side band (6) of the hollow section (2), and parallel thereto a hold-down clamp (17) is provided for at least a portion of the other side band (6) of the hollow section (2), and a distance between the hold-down clamp (17) and the support (16) corresponds approximately to a width of the hollow section (2) and thereby to a clearance between two glass sheets to be held apart, the hold-down clamp (17) is subdivided into rotatable and stationary elements (171, 172), the rotatable element (171) of the hold-down clamp situated in the bending area (4) is rotatable in a bending direction at least approximately around a bending angle about a rotation axis (18) arranged one of approximately through a neutral axis of the hollow section (2) to be bent or displaced radially toward the interior of the bend, and the stationary element (172) of the hold-down clamp is situated before the rotatable element (171) in the feed direction of the hollow section (2) and is mounted in a stationary position.

2. Apparatus according to claim 1, wherein the rotation axis (18) for the rotating element (171) of the hold-down clamp coincides with a swivelling axis of the bending tool (11), and a rotation movement of the rotatable element (171) of the hold-down clamp is provided synchronous with the bending motion.

3. Apparatus according to claim 1, wherein the support (16) for the hollow section (2) to be bent has a co-rotatable element (161) situated in the bending area (4) whose rotation axis aligns with that of the rotatable element (171) of the hold-down clamp (17), and that the common rotation axis (18) of the rotatable element of the hold-down clamp and the co-rotatable element of the support is arranged at right angles to a hold-down clamp surface and a surface of the support and consequently at right angles to the side bands (6) of the hollow section (2).

4. Apparatus according to claim 1, wherein the stationary element (172) of the hold-down clamp (17) is adapted to have one of a slight play or sliding fit in relation to the hollow section (2) to be bent.

5. Apparatus according to claim 1, wherein the hollow section (2) is at least one of held play-free and clamped in the feed direction behind the bending area (4) between the hold-down clamp (17) and the support (16) or in the bending tool (11) serving to grasp the leg (12) to be bent.

6. Apparatus according to claim 1, wherein the abutment (13) is deflectably mounted transverse to a longitudinal extension, such that the abutment has a range of action to be movable back and forth between the support (16) and the hold-down clamp (17).

7. Apparatus according to claim 1, wherein the abutment (13) is impinged upon by a compression spring (21) on one side to maintain a distance from the support (16) when the hold-down clamp (17) is raised.

8. Apparatus according to claim 1, wherein the rotatable element (171) of the hold-down clamp (17) and the abutment (13) are connected with each other.

9. Apparatus according to claim 1, wherein the abutment (13) has transversely running grooves (23) distributed over an abutment surface for bands (6) or flanges (10) projecting inwardly on the hollow section (2), and that a number of grooves (23) is selected such that several hollow sections (2) of various width with inwardly projecting bands (6; 10) can be impinged upon.

10. Apparatus according to claim 9, wherein a respective outer wall (24) of a groove (23) of the abutment adapted to grasp a hollow section (2) with a band (6) or a flange (10) forms the rotatable element of the hold-down clamp (17).

11. Apparatus according to claim 1, wherein the abutment (13) is releasably and interchangeably attached.

12. Apparatus according to claim 1, wherein the stationary part (172) of the hold-down clamp (17) and its mounting are adapted to overlap the hollow section (2) to be bent from outside of the bend to be formed.

13. Apparatus according to claim 1, wherein in an area of the holding device (3) for the hollow section (2) to be supplied, a mounting (25) is arranged before the bending area (4), wherein the hold-down clamp (17) projects into the bending area, and that the rotatable element (171) of the hold-down clamp carries on this projecting part a hold-down clamp leg (173) which directly impinges upon the bending area (4) and is co-swivellable with the bending motion during bending operation, which is fastened on a bending tool (11) executing the bending motion of the leg (12) of the hollow section (2) to be bent.

14. Apparatus according to claim 1, wherein the rotatable element (171) of the hold-down clamp (17) continues in an extension direction of the leg (12) of the hollow section (2) to be bent, grasping the leg (12) adjacent to the bending area (4).

15. Apparatus according to claim 1, wherein the rotatable element (161) of the support (16) comprises a rotation plate sloping radially outwardly.

16. Apparatus according to claim 1, wherein a spacer (22) is provided on a surface of the abutment (13) facing the hold-down clamp (17).

* * * * *